United States Patent [19]

Doyle

[11] 4,306,721

[45] Dec. 22, 1981

[54] GOLF PUTTER WITH SIGHTING DEVICE

[76] Inventor: Louis D. Doyle, 32772 Water St., Richwood, Ohio 43344

[21] Appl. No.: 138,862

[22] Filed: Apr. 8, 1980

[51] Int. Cl.[3] ..... A63B 53/00

[52] U.S. Cl. ..... 273/163 R; 273/183 D

[58] Field of Search ..... 273/77 R, 80 R, 80 C, 273/80.2, 80.1, 81 R, 81.2, 162 R, 162 F, 163 R, 163 A, 164, 183 D, 183 E, 186 R, 186 A, 193 R, 194 R, 79, 168

[56] References Cited

U.S. PATENT DOCUMENTS

| | | | |
|---|---|---|---|
| D. 205,229 | 7/1966 | Reed | 273/167 C X |
| D. 255,477 | 6/1980 | Gida | 273/167 C X |
| 670,522 | 3/1901 | Thompson | 273/79 |
| 1,331,499 | 2/1920 | Hartford | 273/163 R |
| 1,610,802 | 12/1926 | McNair | 273/79 |
| 1,713,158 | 5/1929 | Anderson | 273/79 |
| 1,765,982 | 6/1930 | Keating | 273/79 |
| 1,879,117 | 9/1932 | Davidson | 273/79 |
| 1,897,264 | 2/1933 | Lamb | 273/163 R |
| 2,027,452 | 1/1936 | Rusing | 273/79 |
| 2,111,249 | 3/1938 | Plese | 273/186 A |
| 2,363,991 | 11/1944 | Reach | 273/80.2 |
| 2,691,525 | 10/1954 | Callaghan | 273/79 |
| 3,298,693 | 1/1967 | Eisenberg | 273/183 D |
| 3,423,089 | 1/1969 | Andis | 273/80.1 |
| 3,430,957 | 3/1969 | Andis | 273/80.1 |
| 3,595,582 | 7/1971 | Chapman | 273/183 D |
| 3,840,231 | 10/1974 | Moore | 273/79 |
| 3,909,005 | 9/1975 | Piszel | 273/80.1 X |
| 3,931,969 | 1/1976 | Townhill | 273/79 |
| 4,204,332 | 5/1980 | Gray | 273/183 D X |

*Primary Examiner*—Richard J. Apley

*Attorney, Agent, or Firm*—Buell, Blenko, Ziesenheim & Beck

[57] ABSTRACT

A golf putter with an adjustable sighting device to improve accuracy of putting, particularly on hilly terrain. A directional dial is fixed above the club head with a pointer just below the dial being rotatable by the golfer to different positions relative to the dial to fix a direct line between the ball and the cup independently of the angular position of the club head. The pointer is carried in a horizontal position generally at right angles to a rod that rotates in a bore within a tubular fitting by which the club shaft is secured to the club head. A steel cable coaxially secured to the rod extends telescopically through the hollow club shaft to a rotary cap or knob on the upper end of the club shaft by rotation of which the golfer is able to adjust the pointer relative to the dial to obtain a directional fix on the cup. Thus, independently of the terrain, the golfer may stroke the club head on a line coincident with the direct line to the cup enabling the angularly disposed club head to strike the ball appropriately to cause the ball to take a curved path to the cup compensatory to the amount of lateral slope on the green. In a modified embodiment, a pointer is permanently fixed to the club shaft in a position perpendicular to the face of the club head.

8 Claims, 6 Drawing Figures

GOLF PUTTER WITH SIGHTING DEVICE

This invention relates generally to golf putters and has particular relation to a golf putter having a directional sighting device thereon by which a golfer may readily and quickly obtain a directional fix between the ball and the cup. On a green of uneven or hilly surface the golfer may thus stroke the club head of the putter on a line coincident with the directional fix to cause the ball to take a curved path to the cup appropriate to the hilly terrain. My golf putter with sighting device thus enables a golfer by exercising a little judgment as to the angle to hold the club head when putting a ball on a sloping green to obtain a remarkable degree of accuracy in putting.

To provide a golf putter with a sighting device to enable a relatively unskilled golfer to improve his accuracy of putting, especially on hilly or sloping greens, I provide a wire pointer, in the form of an arrow head, attached to the club shaft at right angles to the face of the club head.

In a variant form, I provide a circular dial or disc fixed horizontally on a shoulder of a screw fitting by which the shaft of the club handle is attached to the club head. The wire pointer in this embodiment is attached at a right angle to a rod that rotates coaxially within a longitudinal bore in the screw fitting, the pointer being positioned immediately below the dial so as to be aligned with angularly spaced lines on the dial. A flexible steel cable suitably attached to the rotary rod extends telescopically through the hollow club shaft to a rotary cap or knob on the upper end of the club shaft to enable the golfer to rotate the pointer to a position coincident with a direct line to the cup from the ball. A friction or ratchet means locks the cap or knob in a position to which it is rotated so as to hold the pointer correspondingly in a fixed position.

Additional details of my improved golf putter are described hereinafter in connection with the accompanying drawings, wherein.

Figure 1:
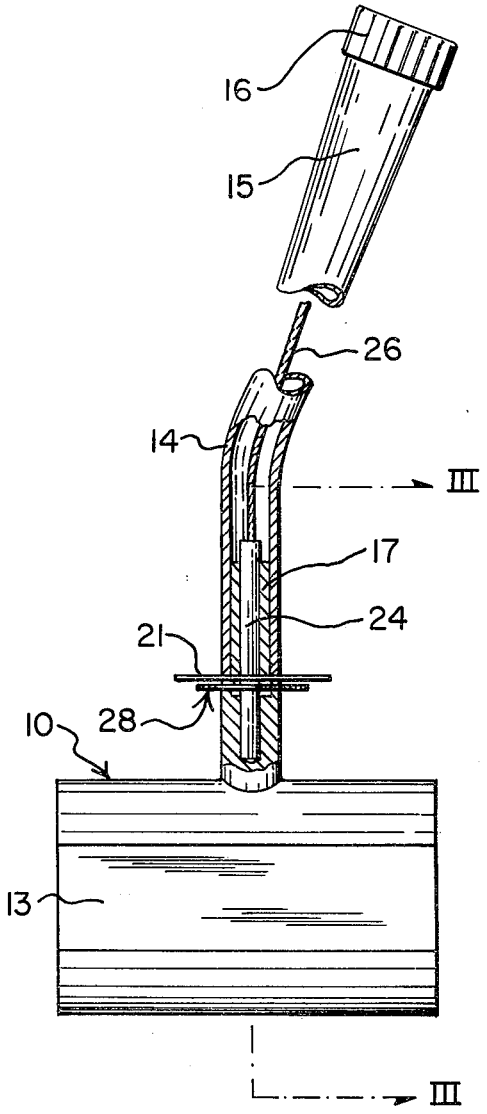
FIG. 1 is an elevational side view of a preferred embodiment of my improved golf putter, the view being at full scale dimensions but having the club shaft or handle foreshortened or broken for convenience of illustration.
Figure 2:
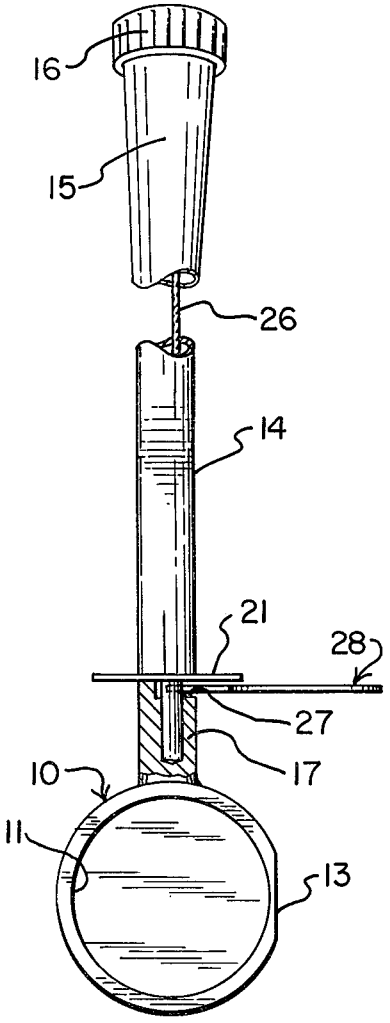
FIG. 2 is a full scale view of the golf putter in FIG. 1, turned through 90° to a position wherein the putter may be viewed from one end.
Figure 3:
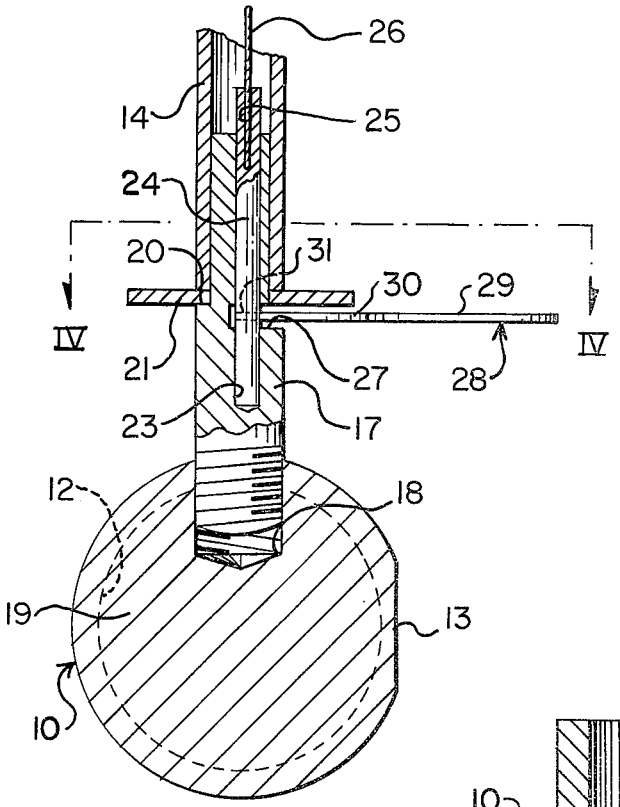
FIG. 3 is a fragmentary sectional view, on enlarged scale, taken substantially on the line III—III of FIG. 1.
Figure 4:
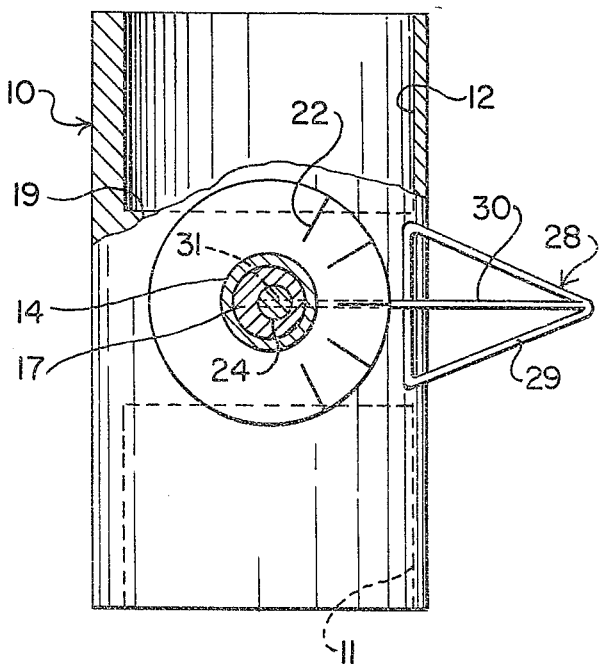
FIG. 4 is a horizontal sectional view taken on the line IV—IV of FIG. 3.

Referring to FIGS. 1 to 4 of the drawings there is shown a preferred embodiment of my improved golf putter, comprising a club head 10 of suitable metal, such as brass or stainless steel, illustratively shown as of substantially cylindrical form, having cylindrical cavities 11 and 12 opening at opposite ends respectively, and a putting face 13 extending the length of the club head in chordal relation to the circular periphery. Attached to the club head 10 is a shaft or handle 14 of conventional length and tapered construction with a portion at the upper end provided with suitable material such as cork to constitute a grip 15. A rotary cap or knob 16 is rotarily attached to the upper end of the club shaft so as to provide a friction or ratcheting resistance to turning for a purpose hereinafter made apparent.

The shaft 14 is tubular and the lower end thereof telescopes over a cylindrical end portion on an adapter fitting 17 to which it is firmly bonded as by a shrink fit. As seen particularly in FIG. 3, the adapter is externally threaded and screws into a tapered radial bore 18 in the central solid portion 19 of the club head.

Substantially midway of the length of the adapter fitting 17 is an annular shoulder 20 on which a washer-like disc or dial 21 is seated, the dial having angularly spaced radial lines 22 in the upper face thereof. It will be seen that the end of the tubular shaft 14 fits down on the cylindrical portion of the adapter 17 into contact with the upper face of the disc 21, thus holding the disc firmly in a position perpendicular to the longitudinal axis of the adapter fitting 17.

The adapter fitting 17 has formed therein a bore 23, extending longitudinally toward the club head 10 from the upper end thereof, in which is a close-fitting rod 24. The rod 24 is free to rotate in the bore 23 and is supported at its lower end on the bottom of bore 23. As will be noted in FIGS. 2 and 3, the bore 23 is off-center with respect to the longitudinal axis of the adapter fitting 17 for a reason later explained.

The rod 24 has a bore 25 in the upper end thereof in which one end of a flexible shaft, such as a steel cable 26 is fixed. The other end of the steel cable is fixed to the cap or knob 16 so that rotation of the cap effects corresponding rotation of the rod 24 in the bore 23.

The adapter fitting has a horizontal arcuate slot 27 immediately below the annular shoulder 20 to accommodate a pointer 28. Pointer 28 may be fabricated of wire, such as 0.055 diameter spring steel, formed so as to have a triangle or arrow head 29 at one end of a stem 30. A hole 31 is drilled radially in the rod 24 at the level of the arcuate slot 27, in which hole the other end of the stem 30 of the pointer 28 is fixed. It will thus be seen that while in a putting position over the ball a golfer can by rotation of the knob 16 turn the pointer 28 into a position coinciding with a direct line between the ball and the cup into which the ball is to be received. Moreover, once the knob 16 is set in position it is locked therein by the friction on ratcheting means active on the knob.

It will now be apparent that the bore 23 for the rod 24 is offset from the longitudinal axis of the adapter fitting 17 in order to leave enough cross-sectional area for rigidity in the cylindrical portion of the adapter fitting 17 notwithstanding the arcuate slot 27.

In use, the golfer using my club is informed accurately as to the line along which the club head must travel in a direct line to the cup. Notwithstanding, the golfer must still exercise judgment as to the angle to hold the club head with respect to the direct line to the cup and the degree of force with which the ball must be struck. I do not claim that my improved club will insure complete accuracy of travel of a golf ball on a green on sloping or inclined terrain. However, information as to the one factor, namely the line on which the club head must be stroked, is assured. To the extent that this information is of assistance to the golfer in putting, my improved putter will prove useful, especially to the relatively unskilled golfer.

Figure 5:
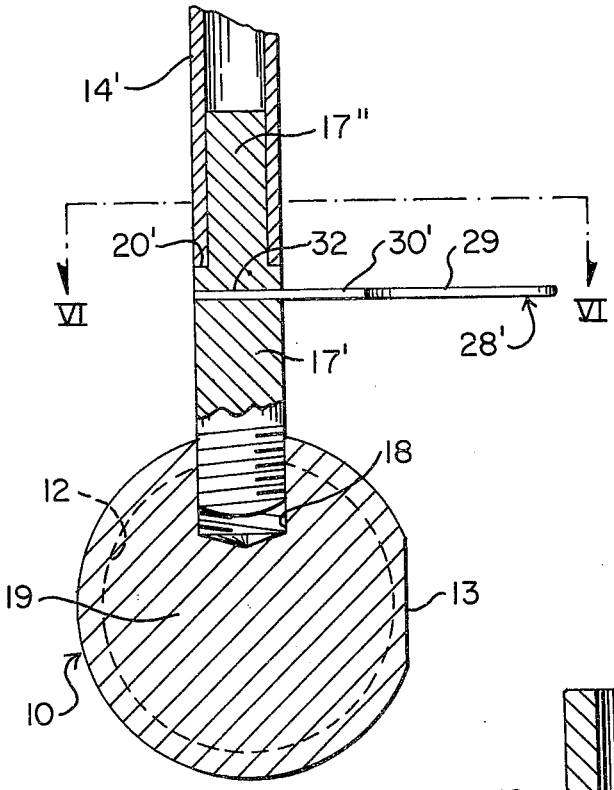
FIG. 5 is a fragmentary sectional view, corresponding to FIG. 3, showing a simplified embodiment of the invention in which the directional pointer is permanently fixed to the club shaft.
Figure 6:
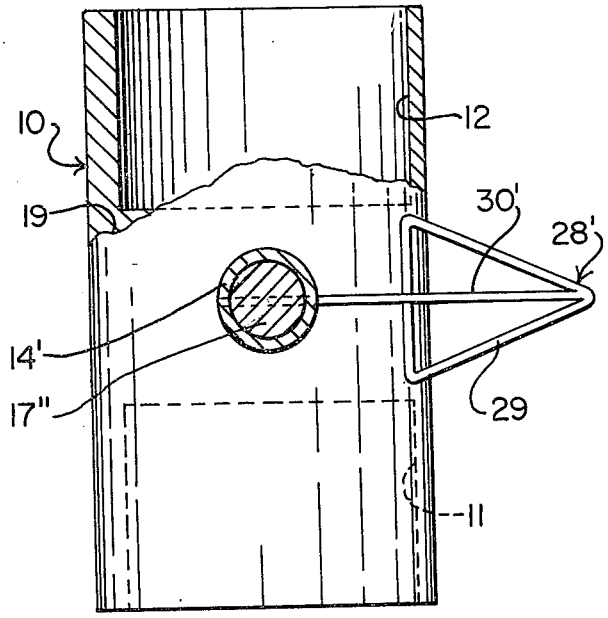
FIG. 6 is a horizontal sectional view, taken on the line VI—VI of FIG. 5.

A modified embodiment of my improved golf putter is shown in FIGS. 5 and 6. This embodiment is quite similar in part to the previous embodiment and corresponding parts in the two embodiments are therefore identified by the same reference numerals without duplicative description. The golfing putter shown in FIGS. 5 and 6 differs from the previous embodiment in that a different adapter 17' is employed for attaching the tubular club shaft 14' to the club head 10. Adapter 17' has an upper end portion 17'' of reduced diameter over which the tubular end of the club shaft is fitted. The end of the club shaft is pressed on the end portion 17'' unti it strikes an annular shoulder 20' formed at the lower extremity of the end portion 17''. In this form of the invention a simple tubular club shaft 14' of conventional form is employed for reasons which will become apparent.

A pointer 28', similar in appearance to the pointer 28, is provided for direct attachment to the adapter 17'. For this purpose the adapter 17' has a diametral bore 32 therethrough for receiving the end of the stem 30' of the pointer. Bore 32 is very carefully drilled, after the adapter 17' is fixed in the club head 10, to assure complete accuracy with regard to having the axis of the bore 32 be perpendicular to the face 13 of the club head 10. The wire stem 30' of the pointer 28' conforms closely in diameter to that of bore 32 and various known means may be employed for securing the stem 30' in the bore 32, such as brazing.

In use, the golfer simply holds the club so that the pointer 28' is in a direct line to the cup toward which he is directing the ball, or on an angle thereto, to allow for unevenness in the surface of the putting green before striking the ball.

While I have shown several embodiments of my improved golfing putter, it should be apparent that further modifications thereof are possible within the terms of the following claims. For example, while I have illustrated and described a golfing putter for a right-handed golfer it will be apparent that a simple reversal of the position of parts will adapt the putter for a left-handed golfer. Moreover, while I have shown a club head of cylindrical form or nearly so, other forms of club heads may be employed.

I claim:

1. A golfing putter having a club head and a shaft therefor, wherein the improvement comprises a pointer supported in a generally horizontal position on the shaft of the club above the club head, and means for adjusting the angular position of the pointer with respect to the face of the club head, and wherein the shaft is tubular and fits telescopically over a cylindrical element attached radially to the club head, and wherein said element has a longitudinal bore and a rod rotatable therein, said pointer being carried by said rod in a position at a right angle to the said rod.

2. A golfing putter according to claim 1 wherein the club head is a hollowed cylinder having a flattened putting surface along the full length of one side thereof in chordal relation to the periphery of said cylinder and the plane of which is substantially parallel to the axes of said cylinder and said shaft.

3. A golfing putter having a club head and a shaft therefor, wherein the improvement comprises a pointer supported in a generally horizontal position on the shaft of the club above the club head, and means for adjusting the angular position of the pointer with respect to the face of the club head, and wherein the shaft is tubular, and wherein the means for adjusting the angular position of said pointer comprises a knob at the upper end of the club shaft and a flexible shaft within said club shaft connecting said knob to said pointer.

4. A golfing putter according to claim 3, wherein friction means is provided to lock the said knob in a position to which it is moved.

5. A golfing putter having a club head and a tubular shaft therefor, wherein the improvement comprises a tubular element intervening between said shaft and the club head, said tubular shaft fitting telescopically over one end of said tubular element, the other end of which is attached to said club head whereby the shaft is attached to the club head, said tubular element having an external annular shoulder thereon, and an annular disc supported coaxially on said shoulder and held fixed thereon by the end of said shaft fitting telescopically over said one end of the tubular element bearing against said annular disc on said shoulder, said disc having angularly spaced gradations, and a pointer rotatably supported on said tubular element for adjustment relative to the gradations in said annular disc.

6. A golfing putter according to claim 5, wherein said tubular element has a longitudinal bore therein, and a rod rotatable in said bore, said pointer being attached at a right angle to said rod, and said tubular element having an arcuate slot therein through which said pointer extends.

7. A golfing putter according to claim 6, wherein said pointer is fabricated of wire and comprises a stem having attached on the end thereof a figure in substantially triangular form.

8. A golfing putter according to claim 6, wherein means is provided for rotating said rod, comprising a rotary knob on the upper end of the club shaft, and a flexible shaft extending telescopically within said tubular club shaft connecting said knob to said rod.

* * * * *